US005660090A

United States Patent [19]

Deri

[11] Patent Number: 5,660,090

[45] Date of Patent: Aug. 26, 1997

[54] AUTOMATIC SCREW DRIVING MECHANISM

[76] Inventor: Yosef Deri, 321A Crowells Rd., Highland Park, N.J. 08904

[21] Appl. No.: 391,341

[22] Filed: Feb. 21, 1995

[51] Int. Cl.[6] ..... B25B 23/06

[52] U.S. Cl. ..... 81/434; 81/57.37

[58] Field of Search ..... 81/433, 434, 435, 81/57.37

[56] References Cited

U.S. PATENT DOCUMENTS 5,101,697 4/1992 Fishback ..... 81/434

5,231,900 8/1993 Deri ..... 81/57.37

*Primary Examiner*—D. S. Meislin

*Attorney, Agent, or Firm*—Henry I. Schanzer

[57] ABSTRACT

A screw feeding mechanism preferably for use with a hand held drill comprising a hollow sleeve, a magazine for holding screws in communication with the inside of the sleeve, and a hollow liner comprising a tubular wall disposed within the sleeve for axial movement therethrough. The liner wall has an axially extending opening therethrough which is movable into overlapping relationship with the magazine for allowing insertion of a screw from the magazine into the liner through the liner opening. An elongated screw driving rod is disposed within the liner and is axially movable therein for engaging a screw within the liner. A screw advancing mechanism is disposed within the magazine for advancing successive screws into the liner. The screw advancing mechanism is activated for synchronous movement with the liner which is moved, in turn, in response to movement of the screw driving rod.

7 Claims, 8 Drawing Sheets

AUTOMATIC SCREW DRIVING MECHANISM

BACKGROUND OF THE INVENTION

This invention relates to screw driving apparatus, e.g., drills, and particularly to a mechanism for attachment to a conventional drill for providing it with an automatic screw driving capability.

Screw driving apparatus including means for automatically feeding screws into the path of a screw driving bit, are known, see, for example, U.S. Pat. Nos. 4,047,611, 4,146,071, 4,404,877, 4,625,597, 5,027,679, and 5,083,483, the subject matter of which are incorporated herein by reference. Also incorporated herein are the teachings of U.S. Pat. No. 5,231,900 which issued to me. U.S. Pat. No. 5,231,900 and some of the other patents disclose, in one form or another, an elongated drill bit, means for rotating the bit about its long axis, and means for advancing and retracting the bit within an elongated sleeve. The sleeve has an opening through its wall and means are provided for sequentially inserting screws from a magazine into the sleeve through the sleeve opening and into the path of the drill bit. The bit engages the screw, advances it forwardly out of the sleeve into contact with a workpiece and drives the screw into the workpiece. The drill bit is then retracted rearwardly of the sleeve opening whereupon a new screw is injected into the sleeve for a repetition of the process.

The various patents disclose different arrangements for storing and holding the screws and for advancing them. In general, the screw advancing mechanisms tend to be complex, heavy and expensive. My patent U.S. Pat. No. 5,231,900 discloses a relatively simple screw driving mechanism, including a spring driven magazine.

The present invention includes an improvement in a screw storing and/or holding magazine, making it safer and more simple to load, and particularly to an improvement in the mechanism for advancing screws into an elongated sleeve for engagement with a drill bit.

SUMMARY OF THE INVENTION

An automatic screw feeding mechanism comprises an elongated sleeve including an elongated screw driving rod slidably received within the sleeve. The sleeve has a side opening allowing entry of screws into the sleeve from a screw magazine. Also disposed within the sleeve is a tubular liner in which is received the screw driving rod. The liner also has a side opening allowing entry therein of a screw. The liner is slidably movable relative both to the surrounding sleeve and the inner screw driving rod, and means are provided for coupling and decoupling the liner from the rod allowing, during different portions of an operating cycle, axial movement of the liner within the sleeve in response to movements of the rod, and axial movement of the rod relative to the liner while the liner is in fixed position within the sleeve. The liner carries a drive means for driving a screw advancing mechanism for advancing a screw from the magazine through the sleeve and liner openings into the liner.

In use, the rear end of the screw driving rod is mounted in the chuck of a drill held in one hand of a user. The screw storing magazine, attached to the sleeve, may be held in the user's other hand. The drill is first moved rearwardly for retracting the screw driving rod relative to the sleeve for clearing the forward end of the rod rearwardly of the liner opening and for moving the liner rearwardly for overlapping the liner opening with the magazine. Movements of the liner are used for driving the screw advancing mechanism for advancing a screw from the magazine into the liner.

In a preferred embodiment, the screws in the magazine are disposed in spaced apart relation along a belt of screws. An edge of the opening through the liner comprises a knife edge which, upon further rearward movement of the liner after insertion of a screw therein, cuts through the belt for separating the inserted screw from the belt.

DESCRIPTION OF THE DRAWING

FIG. 2A, however, showing a change in the relative positioning of the illustrated components;

DESCRIPTION OF PREFERRED EMBODIMENTS

Figure 1:
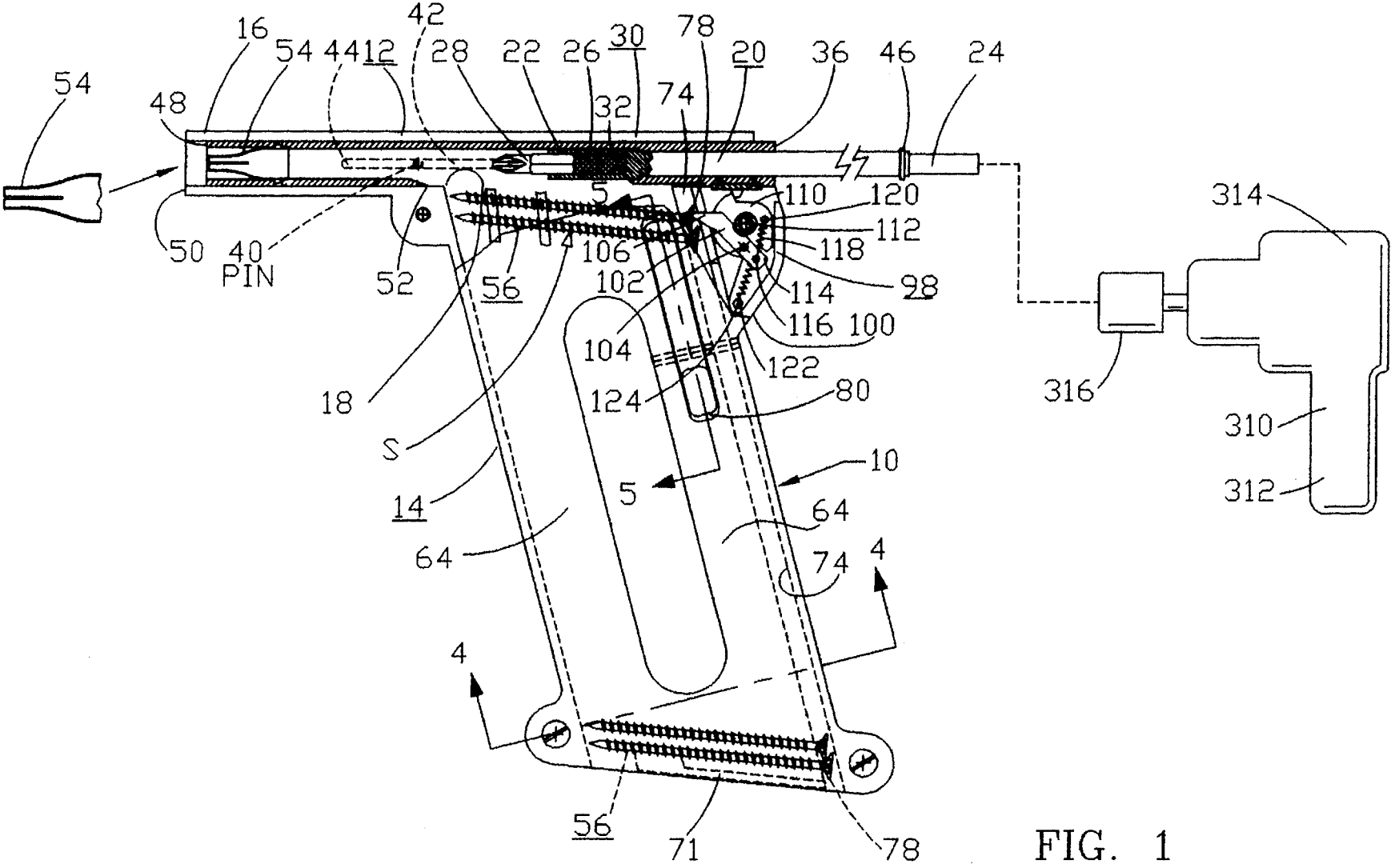
FIG. 1 is a side elevation, partially in section, showing a screw driving mechanism according to this invention.
Figure 2:
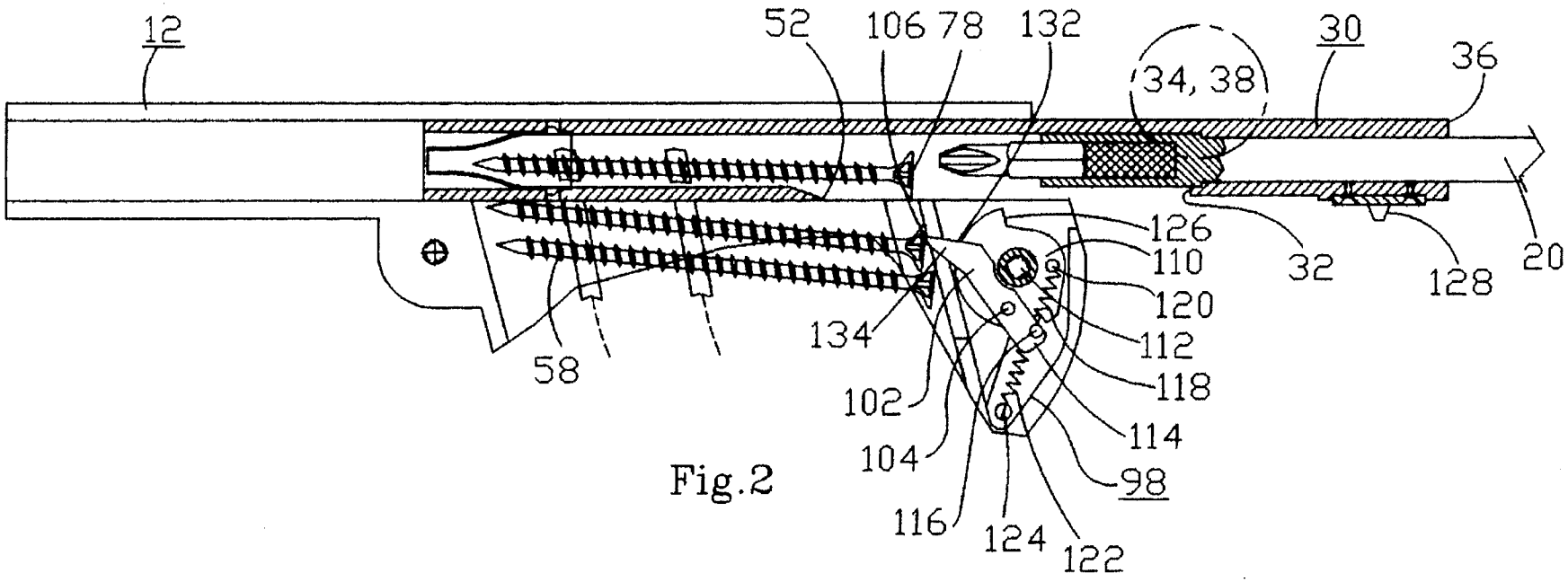
FIG. 2 is a view, on an enlarged scale, of a portion of the mechanism shown in FIG. 1 and showing a change in relative positions of certain components of the mechanism.

With reference to FIGS. 1 and 2, there is shown a screw feeding mechanism 10 comprising an elongated sleeve 12 fixedly mounted on an end of a screw receiving magazine 14. The sleeve 12 comprises a tubular wall 16 having an opening 18 along the side of the tubular wall in alignment with the interior of the magazine 14 whereby a screw S received within the magazine can be inserted into the sleeve 12. Slidably disposed within the sleeve 12 is an elongated screw driving rod 20 having a "front" end 22 and a "rear" end 24. As is typical, and as disclosed in my afore-cited U.S. Pat. No. 5,231,900, the front end 22 comprises an open-ended, tubular member 26 for receipt of a replaceable screw driving bit 28. Preferably, the interior of the member is hexangular in cross-section for firm grasp of the inserted bit 28, and a magnet is disposed at the rear end of the member 26 for releasably holding the bit 28 within the member 26.

The rear end 24 of the rod 20 is adapted for receipt within the chuck 316 of a hand held drill 310 as more fully set forth in U.S. Pat. No. 5,231,900, the teachings of which are incorporated herein by reference, and, to this end, the rod rear end 24 can be solid with a round or hexagonal cross-section for conventional mating with the drill chuck.

Also disposed within the sleeve 12 is a hollow, tubular liner 30 which fits relatively snugly within the sleeve. 12 but which is readily slidable within the sleeve 12. The aforementioned screw driving rod 20 is disposed within the liner 30 and, while fitting relatively snugly therewithin, is also readily slidable within the liner 30.

As mentioned, the sleeve 12 has an opening 18 therethrough allowing insertion of a screw into the sleeve 12, and the liner 30 has a similar opening 32 through which the screw can pass for disposition within the liner 30. (In FIG. 1, reference numeral 32 designates both the opening through the liner wall and the rearward edge of the opening. The forward edge of the opening 32 is designated by reference numeral 52.)

In use of the mechanism 10, as more fully described hereinafter, a user holds the magazine in one hand and a hand drill (in which the screw driving rod 20 is rigidly clamped) in the other. The user's hands are then alternately moved towards and away from one another for causing the screw driving rod to reciprocate forwardly and rearwardly within the sleeve 12. The liner 30 also reciprocates axially within the sleeve in response to the rod axial movements, but only through a relatively short range of movements, and, for obtaining such liner movements, stop means are provided for latching and delatching the liner to and from the rod.

Figure 2A:
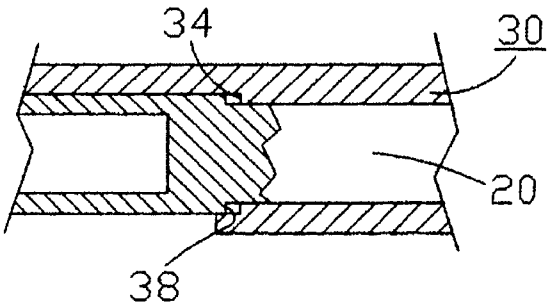
FIG. 2A is an enlarged view of an encircled portion of FIG. 2.

For causing rearward movement of the liner 30 in response to rearward movement of the screw driving rod 20, the inner surface of the wall of the liner 30 is provided (FIGS. 2 and 2A) with an annular ledge 34 towards the rear end 36 of the liner. That is, the thickness of the liner wall is slightly increased rearwardly of the ledge 34. The screw driving rod 20 has a mating annular ledge 38 formed by the rod having a slightly increased diameter forwardly of the ledge 38.

As shown in FIG. 1, the screw driving rod 20 is in the process of being rearwardly pulled, and the liner 30 is similarly being pulled rearwardly by means of the engagement of the two ledges 34 and 38. In the position illustrated, the opening 32 through the liner 30 is moving rearwardly and is partially overlapped with the opening 18 through the sleeve 12. At some point (discussed further hereinafter) further rearward movements of the rod 20 and the liner 30 are no longer needed or desirable, and for limiting such further movements, a pin 40 is provided on the side of the sleeve 12 facing away from the viewer Of FIG. 1 (i.e., the pin 40 projects downwardly from the plane of FIG. 1). The pin 40 extends through the sleeve wall and is slidably received within an axially extending groove or depression 42 in the exterior surface of the liner 30, and when the pin 40 engages forward end 44 of the slot 42, further rearward movement of both the liner 30 and the rod 20 relative to the sleeve 12 is prevented.

Thereafter, the screw driving rod is pushed forward through the sleeve 12. Owing to the snug fit between the liner 30 and the sleeve 12, the liner 30 tends to remain in place while the screw rod 20 is first advanced forwardly through the liner. The liner, however, has to be eventually forwardly advanced within the sleeve 12, and to this end, a rear end portion of the rod 20 is provided with a radially extending annular ledge 46, e.g., a C-ring mounted within a circumferential slot in the rod. As the rod advances through the liner, the rod ledge eventually engages the rear end 36 of the liner 30 and begins to drive the liner forward.

Figure 3:
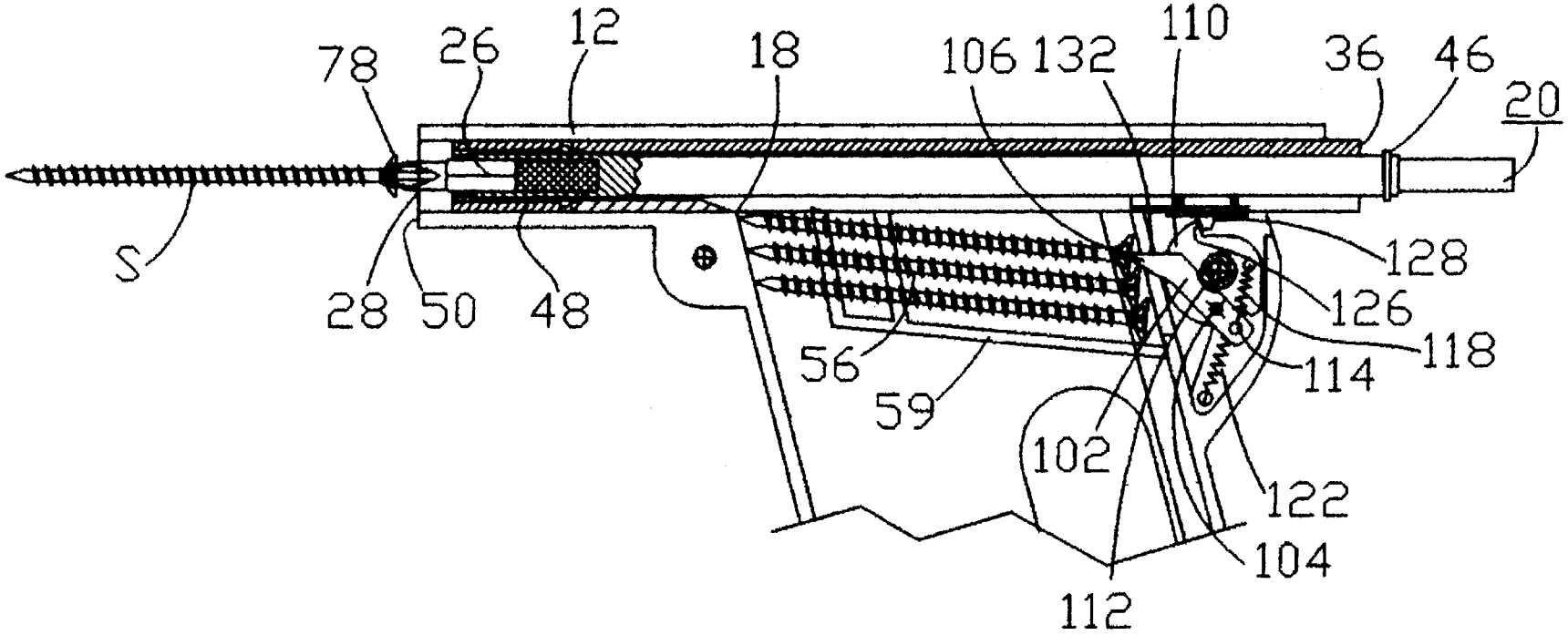
FIG. 3 is a view similar to FIG. 2 showing a further change of position of the mechanism components.

FIG. 3 shows the liner 30 in the process of being forwardly advanced. Eventually, although not illustrated, the front end 48 of the liner 30 becomes about flush with the front end 50 of the sleeve 12. Further forward movement of the liner 30 within the sleeve 12 is prevented when the pin 40 (FIG. 1) engages the rear end (not shown) of the groove 42 along the liner wall. The positioning of the liner in its forward position is not critical, although it is important that the liner is in some forward position, that is, in a position from which rearward movement can occur.

FIG. 3 also shows the forward position of the screw driving rod 20 approaching its maximum forward position. Such maximum forward position is also not critical, but, preferably, the drill bit 28 on the end 26 of the rod 20 extends at least slightly beyond the end 50 of the sleeve for enabling driving a screw fully into the workpiece receiving the screw.

For providing centering of a screw as it is pushed outwardly of the mechanism 10, the front end 48 of the liner 30 includes (FIG. 1) a hollow conical member 54, e.g., of plastic or metal. The member 54 is conical in shape, so as to center a screw being fed through the member, but the wall of the member has an axially extending slit allowing expansion of the inner diameter of the member 54 to allow passage therethrough of the leading end 26 of the screw driving rod 20, as shown in FIG. 3

Figure 3A:
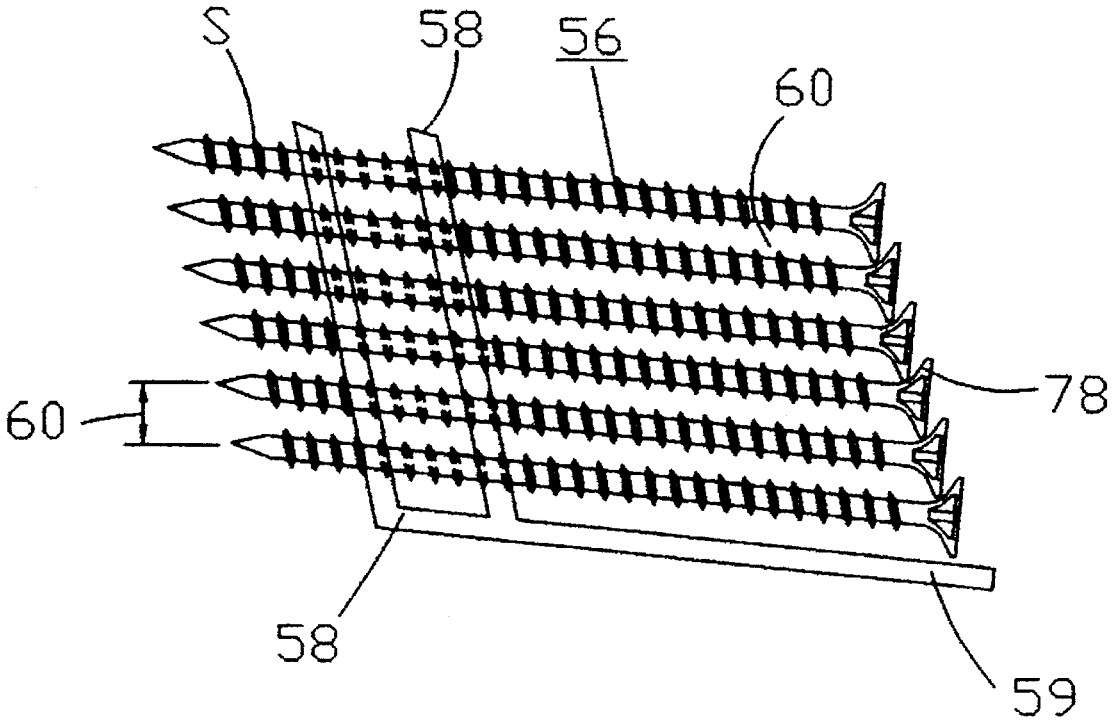
FIG. 3A is a side elevation of a strip of held together screws for use with the inventive mechanism.

The screws being driven are fed into the liner 30 from the magazine 14. In a preferred embodiment, the screws in the magazine are disposed in a belt-like arrangement, e.g., in a strip 56 (FIGS. 3 and 3A) of spaced apart screws held in place by parallel straps 58 of molded plastic. Known plastic injection molding processes can be used for fabricating the screw strips 56. For cooperation with a particular screw advancing mechanism to be described, spaces 60 are provided between adjacent screws S, the screws are parallel to one another; and, when the screws are disposed in the magazine 14 as shown in FIG. 3, the screws are in staggered relationship, with each screw, from top to bottom of the screw strip 56, being disposed slightly to the left (as illustrated) of its adjacent underlying screw. Also, for a reason described hereinafter, the two straps 58 are integrally connected to a rigid rod 59 serving as a strip bottom-most dummy screw.

Figure 4:
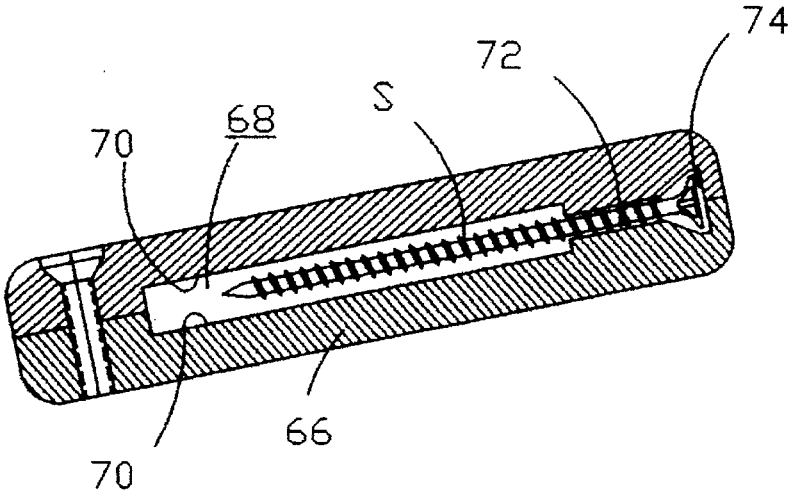
FIGS. 4 and 5 are cross-sectional views taken along lines 4—4 and 5—5 of FIG. 1, respectively.

The screw containing magazine 14 (FIGS. 1 and 4) is generally rectangular in shape and comprises two screwed together side walls 64 an 66 providing an interior, hollow space 68 extending entirely through the magazine from top to bottom. Thus, the magazine is open at the bottom end 71 for receipt of a screw strip 56 and opens, at the upper end, directly into the sleeve 12 via the sleeve opening 18. In cross-section, the space 68 is shaped to provide three top to bottom slots including, from left to right as shown in FIG. 4, a relatively wide slot 70, a shorter width and shorter height slot 72, and an end slot 74.

As shown in FIG. 1, a strip 56 of screws disposed within the magazine is held precisely in place by means of the heads 78 of the screws being received within the magazine end slot 74 and with the front ends of the screws being received (FIG. 4) within the slot 70. The screw shanks extend through the slot 72, the short height of which prevents passage of the screw heads for preventing side to side movement of the screws within the magazine.

Figure 5:
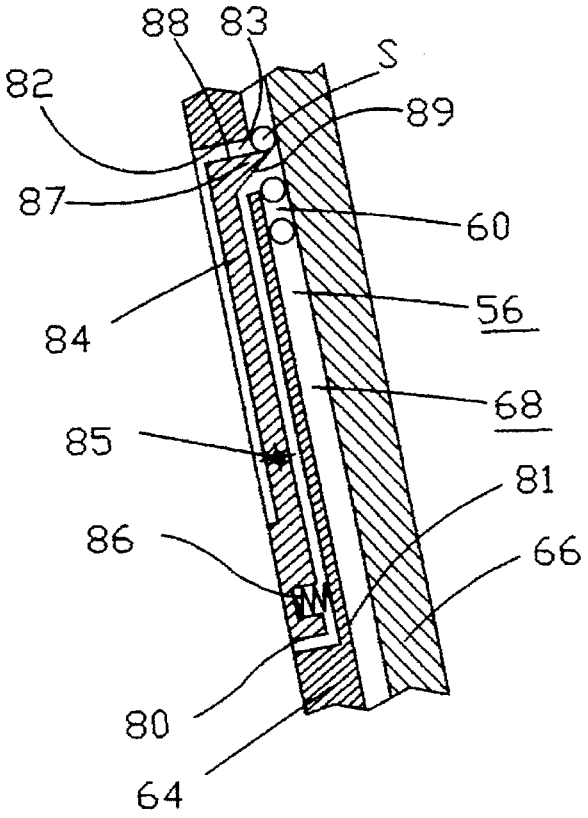

Vertical positioning of a screw strip 56 within the magazine is as follows: As shown in FIGS. 1 and 5, an elongated depression 80 is formed within the magazine side wall 64 having a thin bottom wall 81 forming an interior well of the space 68 within the magazine 14. The wall 81 terminates short of the upper end 82 of the depression and provides an opening 83 into the magazine interior space 68. Disposed within the depression 80 is an elongated strip 84, e.g., of metal, held in place by, and pivotally mounted on, a pin 85 extending through the magazine wall 64. A small spring 86 is mounted in a small opening at the bottom end of the strip 84 and extends outwardly from the opening into engagement with the depression wall 81. The spring 86 biases the strip 84 for urging a pointed finger 87 on the upper end of the strip forwardly through the depression upper opening 83 and towards the magazine other wall 66. The finger 87 has a flat upper surface 88 and a tapered lower surface 89.

When a screw strip 56 is inserted, e.g., by hand, into the magazine, the leading or topmost screw on the strip 56 eventually engages the tapered lower surface 89 of the finger 87 thereby causing counterclockwise rotation of the strip 84 against the bias of the spring 83 for allowing the passage of the top-most screw past the finger 87. The spring biased finger 87 then snaps forwardly into the space 60 between the top-most screw S and the lower, adjoining screw on the screw strip 56. Downward movement of the screw strip 56 out of the magazine is thus prevented by engagement of the top-most screw with the flat upper surface 88 of the finger, such contact tending to push the finger 87 more firmly towards the magazine wall 66.

In use, the biased strip 84 allows free upward movement of a screw strip 56 for sequential advancing of the screws into the liner 30 (as hereinafter described) while preventing the screw strip 56 from falling out of the magazine.

Conversely, by the user pressing against the lower end of the strip 84 for causing counterclockwise rotation of the strip 84 (and compression of the spring 86), the finger 87 is moved rearwardly out of the magazine space 68 for allowing removal of the screws from the magazine.

The magazine 14 has a further mechanism for raising the screw strip 56 within the magazine for sequentially feeding screws on the screw strip into the liner 30. As described hereinafter, such screw feeding occurs in response to movement of the liner 30 in response to movement of the screw driving rod 20. The screw feeding mechanism 98 is illustrated in FIG. 1 and more clearly in FIG. 2.

The magazine 14 is provided with a rearwardly extending portion 100 for housing the screw feeding mechanism 98. The mechanism 98 includes a pusher rod 102 mounted for rotation about a pin 104. One end 106 of the rod 102 is pointed and adapted to fit into the recess (e.g., of cross-shape in a typical Phillips head screw) in the rearwardly facing surface of a screw head for being firmly seated within the recess. While so seated, the pusher rod 102 is caused to move upwardly (as hereinafter explained) for forcibly raising the screw, hence the entire screw strip 56 within the magazine.

As previously explained, in connection with FIGS. 1 and 4, the magazine 14 contains an elongated slot 74 extending the entire length of the magazine for receipt and positioning of the head ends 78 of the screws. The slot 74 is inclined with respect to the vertical direction in FIGS. 1 and 2, hence successive, screw heads, from bottom to top of the magazine, are off-set from one another towards the left as viewed in these figures. The effect of such off-set is that after a screw S is raised by the pusher rod, movement of the pusher rod 102 slightly to the right and slightly downwardly causes retraction of the pointed end 106 of the pusher rod 102 from the screw being raised and engagement of the pointed end 106 with the adjacent underlying screw. Continued downward movement of the pointed end 106 causes entry of the pointed end into the head recess of the newly engaged screw.

As shown in FIGS. 1, 2 and 3, structure for obtaining the aforedescribed pusher rod movements is as follows:

The pusher rod 102 is mounted for rotation about the previously referred to pin 104, and the pin 104 is mounted on a rocker member 110 having, in this embodiment, a generally circular shape and referred to hereinafter as a cam wheel. The cam wheel 110 is mounted, in turn, on a pin 112 secured to the magazine wall. One end of the pusher rod 102 comprises the aforedescribed pointed end 106, and the other end 114 of the rod 102 includes an extending pin 116 to which a coiled spring 118 is attached. The other end of the spring 118 is attached to a pin 120 secured to the cam wheel 110. A second spring 122 is attached to the cam wheel 110 (e.g., to an extension Of the pin 120 through the wheel 110) and extends beneath and beyond the rod end 102 for attachment to a pin 124 fixedly secured to the magazine wall. The cam wheel 110 includes a radially extending ledge 126 (FIG. 2) adapted to be engaged by a cam controller 128 (e.g., a small cone-shaped member) dependent from the liner 30.

In the position of the mechanism as shown in FIG. 1, the pointed end 106 of the pusher rod 102 is firmly seated within the head recess of the uppermost screw in the magazine. The liner 30 is moving rearwardly at this time, and the cam wheel 110 is rotating clockwise (as the cam controller 128 moves to the right) under the urging of the spring 122 which had previously been stretched (as hereinafter described). In response to the contraction of the spring 122 and the clockwise rotation of the cam wheel 110 (which causes corresponding clockwise movement of the pin 104 on which the pusher rod 102 is rotated), the pointed end 106 of the pusher rod 102 moves both upwardly and slightly to the left. The pusher rod 102 thus lifts the top screw, hence the entire screw strip 56, and moves the top screw into the liner. How the screw actually enters the liner is described hereinafter.

After insertion of the first screw into the liner, the liner is thereafter eventually pushed forwardly by the screw driving rod 20, as previously explained in connection with FIG. 3. The cam controller 128 mounted on the liner 30, then pushes against the cam wheel ledge 126 for causing counterclockwise rotation of the cam wheel 110. Rotation Of the wheel performs three functions: one is that it moves the pusher rod pin 104 downwardly and to the right, thereby retracting the pointed push rod end 106 out of the recess of the uppermost screw in which it had been seated; two is that it causes stretching of the spring 118 for biasing the pusher rod 102 for counterclockwise rotation about its pin 114 for causing, along with the displacement of the pin 114, contact of the pusher rod pointed end 106 with the screw now at the top of the screw strip 56 within the magazine 14, and entry of the pointed end into the head recess of the now topmost screw; and three, it causes stretching of the spring 122 for readying it for causing the afore-described clockwise rotation of the cam wheel 110 for raising the topmost screw when rearward movement of the liner occurs.

The shape of the pusher rod pointed end 106 is of significance. It has (FIG. 2) a horizontal upper surface 132 and a tapered lower surface 134. When the cam wheel 110 is being pushed by the cam controller 128 to rotate counterclockwise and to cause lowering of the pusher rod 102, the tapered surface 134 of the rod end 106 engages the topmost screw in the magazine 14, and the tapered surface 134 allows continued counterclockwise rotation of the rod end 106 along with rearward retraction thereof while not losing contact of the end with the newly engaged screw. Thus, the pointed end of the rod scrapes against the screw head and snaps forwardly into the screw head recess immediately upon the pointed end reaching the recess.

Conversely, when the pusher rod 102 is being raised by the clockwise rotating cam wheel 110 (under urging of the stretched spring 122), the horizontal upper surface 132 of the rod end 106 maintains firm contact with the screw head recess for firmly raising the screw.

Figure 6:
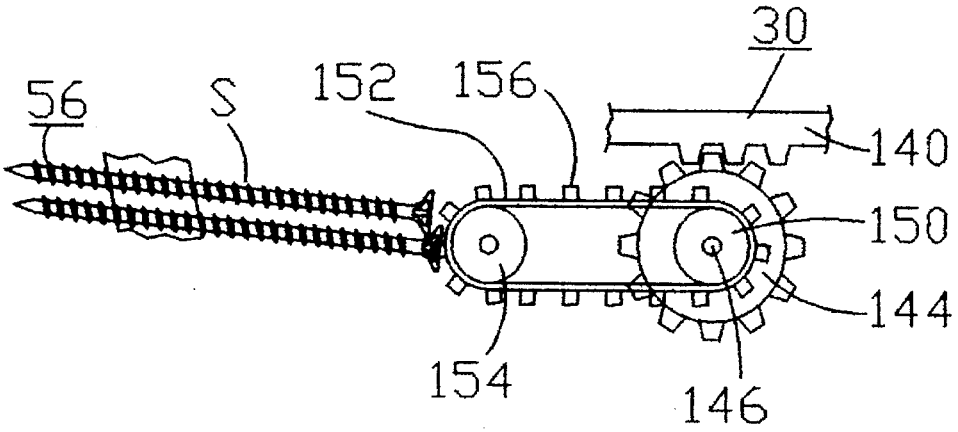
FIGS. 6, 7 and 8 are schematic views showing different screw advancing mechanisms usable within the screw magazine shown in FIG. 1.

Other screw driving means are possible FIG. 6, for example, shows the use of a rack and pinion arrangement for converting linear motion of the liner 30 into rotary motion for advancing the screws in the magazine. A linear rack 140 of gear teeth is mounted on the liner 30 which engages the teeth of a pinion gear 144 mounted for rotation around a pin 146 mounted on the magazine wall. Also rotatably mounted on the pin 146 is a driving wheel 150. Known clutch means (e.g., spring biased pins) are provided whereby, during a counterclockwise rotation of the pinion gear 146, the pinion gear is not coupled to the driving wheel 150 which thus remains stationary. Conversely, during clockwise rotation of the pinion gear 144, the pinion gear is coupled to the driving wheel for causing clockwise rotation thereof.

Mounted on the driving wheel 150 and being rotated thereby is a belt 152 extending to and around an idler wheel 154. The belt includes a plurality of projecting bumps or ridges 156 of resilient but relatively stiff material, e.g., hard rubber, extending outwardly therefrom. In use, as illustrated, when caused to 152 is caused to rotate clockwise, in response to rearward movement of the liner 30, the projecting bumps 156 engage the heads of several adjacent screws with some of the bumps entering the recesses therein. The rotating belt thus raises the screw strip 56.

Figure 7:
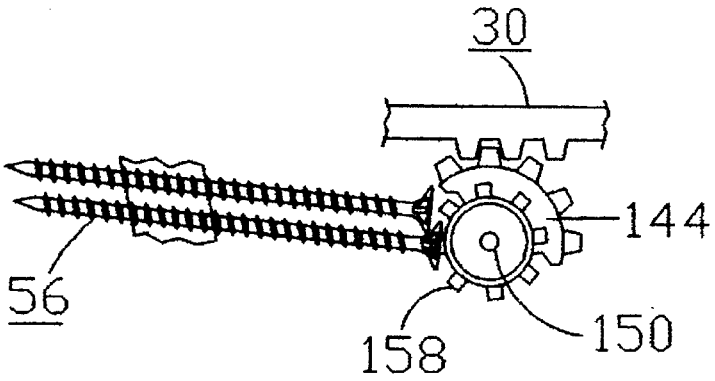

In another embodiment, shown in FIG. 7, the driving wheel 150 itself contains a number of radially extending fingers 158 for entering a screw head recess for raising the screw strip 56.

Figure 8:
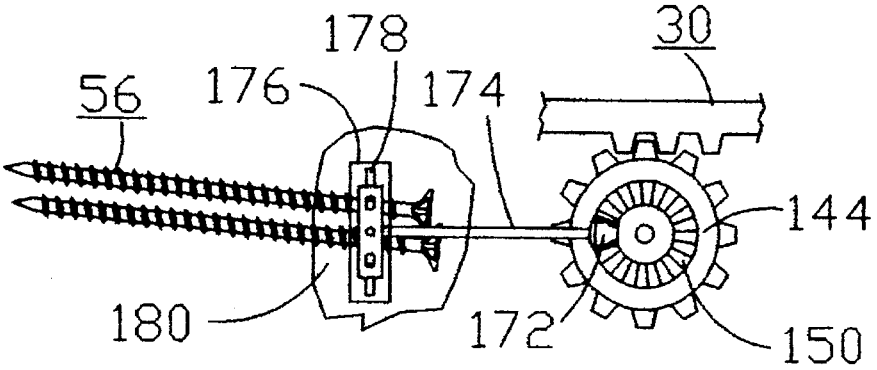

In another embodiment, illustrated in FIG. 8, the driving wheel 150 is a bevel gear for rotating a mating bevel gear 172 mounted on an axle 174 for rotating a screw engaging wheel 176. The wheel 176 is similar to the screw engaging wheel 150 shown in FIG. 7 in that it carries a plurality of radially extending bumps or rods 178 of hard resilient material. The wheel 176 is disposed adjacent to an opening 180 through the magazine wall and the wheel rods project towards the screw strip 56 therein and inwardly between spaced apart screws. In use, rotation of the wheel 176 causes lifting of the screw strip 56 within the magazine. In some instances, dependent on the types of screws to be fed, the engagement by the wheel rods 178 with the shanks of the screws provides a more positive lifting engagement than that provided by engagements with the screw heads as in the FIG. 1, 6 and 7 embodiments.

Figure 9:
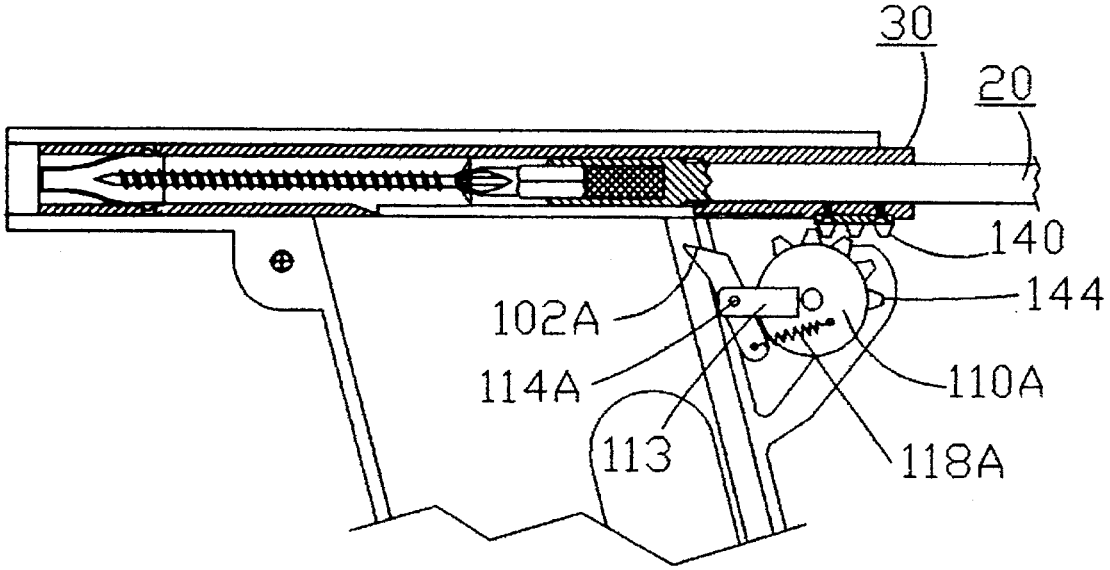
FIG. 9 is a view generally similar to FIG. 2 but showing further changes in positions of the mechanism components as well as a modification of the screw advancing mechanism shown in FIG. 2.

FIG. 9 shows a modification of the screw driving mechanism 98 shown in FIGS. 1–3. In the mechanism 98, clockwise rotation of the cam wheel 110 is caused by contraction of the spring 122 while counterclockwise rotation of the wheel 110 is caused by the cam controller 128 pushing on the cam wheel ledge 126.

In the arrangement shown in FIG. 9, all rotations of the cam wheel 110A are under control of a rack and pinion mechanism, i.e., a linear rack 140 of gear teeth (as in the embodiments shown in FIGS. 6–8) for engagement with gear teeth 144 mounted on the cam wheel 110 A. Accordingly, the wheel 110 A is rotated clockwise in response to rearward movement of the liner 30 and rotated counterclockwise in response to forward movement of the liner. Only three gear teeth (140 and 144) are provided because only limited rotary movement of the wheel 110 A is required.

Except that the spring 122 used in the FIGS. 1–3 mechanism 98 is omitted, operation of the FIG. 9 mechanism is similar to that of the mechanism 98. FIG. 9 shows the pusher rod 102A pivotally mounted on the end of a bar 113 rigidly secured to the cam wheel 110A. This is merely a fabrication detail, and operation of the pusher rod 102A in the FIG. 9 arrangement is substantially similar that of the pusher rod 102 in the mechanism 98.

During operation, as described, the screw strip 56 is raised within the magazine for inserting the top most screw on the strip into the liner 30. The inserted screw, however, is integrally connected to the strip 56 and must be separated therefrom. One possibility is the use of a relatively weak material for forming the screw interconnecting straps 58. Thus, as the screw driving rod 20 is pushed forwardly against the end 78 of the inserted screw, the strap 58 holding the screw is simply broken by the forward thrust against the screw.

A preferred arrangement, however, is to use relatively strong straps 58, for ease of handling of the screw strips without danger of breakage, and to provide means for cutting through the straps for separating the inserted screw from the screw strip.

To this end, the forward edge 52 of the liner opening 32 is shaped to provide a knife edge, i.e., the edge tapers to a sharp point as shown in FIG. 2. Accordingly, after a screw is inserted through the liner opening 38, the knife edge 52 is moved rearwardly beneath the inserted screw (as shown in FIG. 2) and into cutting engagement with the belt straps 58. The inserted screw is thus cut free from the straps 58.

Insertion of the screws into the liner 30 is now described.

FIG. 1 shows the sleeve 12 disposed horizontally. The fit of the screw strip 56 within the magazine is such, however, that the screws are slightly upwardly tilted with respect to the horizontal direction; that is, the front ends of the screws are slightly higher within the magazine than the screw head ends.

FIG. 1 shows an instant when the liner 30 is moving rearwardly. At the position shown, the liner opening 32 is in partially but not fully overlapping relationship with the sleeve magazine opening 18; the screw bit 28 on the end of the rod 20 is beginning to move rearwardly of the opening 18; and the top-most screw in the magazine has been partially raised by the screw advancing mechanism 98. Owing to the upward tilt of the screw, the front end of the screw enters the liner 30 while the screw head end 78 is still disposed below the liner and indeed, while the screw head 78 is still disposed rearwardly of the rear edge 32 of the liner opening (the reference numeral 32 designating both the opening through the liner wall and the rear edge of the opening, as previously noted).

With continued rearward movements of the liner and the screw driving rod, the cutting edge 52 at the front end of the liner opening 32 passes beneath the front end of the screw (FIG. 2) as previously described, and the rear edge 38 of the liner opening 32 moves rearwardly of the head end 78 of the screw for allowing insertion of the full length of the screw into the liner. Full insertion of the screw actually occurs as a result of the rearwardly moving cutting edge 52 engaging the partially inserted screw and driving it upwardly into the liner 30. Also, as the cutting edge 52 passes beneath the topmost screw, the edge 52 cuts through the straps 58 securing the inserted screw to the screw strip 56 in the magazine 14.

It is noted that, in this embodiment, the screws are longer in length than the axial length of the liner opening 32. Insertion of the screws through the shorter length opening 32 is made possible because of the upward tilt of the screws and the synchronized movements between the liner and the screws. One advantage of this arrangement is that, because the front edge 52 of the liner opening passes beneath the front end of the inserted screw before the screw is separated from the screw strip, the liner wall forwardly of the edge 52 is in position to provide underlying support for the screw immediately after it has been cut from the screw strip. Additionally, owing to the underlying support provided by the liner (for preventing screws from falling downwardly out of the liner), screws having lengths shorter than the width of the magazine can be used. This is possible provided the rearward movement of the liner cutting edge 52 is sufficient to bring the edge beneath the front ends of the shorter screws (the head ends of which are held within the magazine slot 74).

A complete cycle of operation of the mechanism is now described.

FIG. 1 has already been described. This figure illustrates the condition where the screw driving rod 20 is being moved rearwardly (by, for example, a user pulling a hand drill clamped to the rod 20 rearwardly of the screw feeding mechanism 10) and the liner 30 is also being pulled rearwardly by the rod 20. The drill bit 28 mounted on the front end 22 of the rod 20, as well as the rear edge of the liner opening 32, are beginning to clear the space overlying the magazine, and a screw is being moved into the liner 30. At this time, the cam wheel 110 mounting the screw pusher rod 102 is being clockwise rotated by contraction of the previously stretched spring 122. Rotation of the cam wheel 110 is possible because the cam controller 128 engaging the cam wheel ledge 126 is being moved rearwardly along with the liner on which the controller is mounted.

Eventually (FIG. 2), the screw is fully inserted within the liner 30, the strap 58 previously securing the inserted screw to the screw strip 56 has been cut by the liner cutting edge 52, and the inserted screw is resting in the portion of the liner forwardly of the cutting edge 52.

Figure 10:
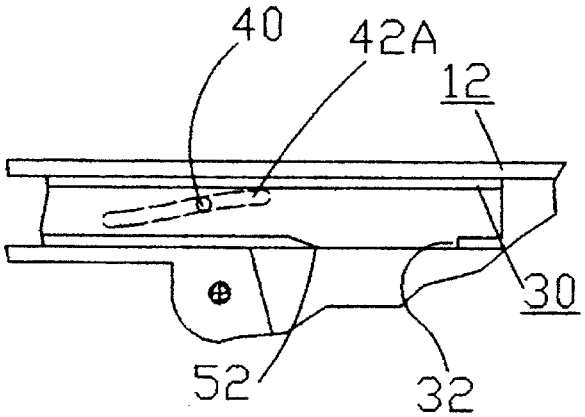
FIG. 10 shows a portion of the mechanism shown in FIG. 1, but showing a modification thereof.

In the illustrated embodiment, the liner 30 moves linearly within the sleeve and along the axis of the liner groove 42 (FIG. 1). If the axis of elongation of the liner groove 42A (FIG. 10) is curved, thus serving as a cam surface followed by the sleeve pin 40, the liner 30 is caused to rotate as it moves axially along the sleeve 12. Such rotation can be desirable for more effective cutting of the straps 80 of the screw strip 56 by the liner cutting edge 52.

Then, the screw driving rod 20 is moved forwardly (FIG. 2) for engaging (FIG. 9) the headend 78 of the screw within the liner and for pushing the screw forward within the liner. Initially, the liner tends to remain stationary until the annular ledge 46 near the rear end 24 of the screw driving rod 20 engages (FIG. 3) the end 36 of the liner 30 for advancing the liner. As the liner advances, the cam controller 128 dependent from the liner pushes against the ledge 126 of the cam wheel 110 for causing counterclockwise rotation of the wheel 110. This serves to stretch the spring 122 and further serves to move the pointed end 106 of the pusher rod 102 out of contact with the head of the now inserted uppermost screw and downward into seated contact within the head recess of the underlying screw.

Both the liner and the screw driving rod are advanced through the sleeve until the screw being pushed by the rod 20 exits (FIG. 3) the forward end 50 of the sleeve and is screwed into a workpiece. How far the drill bit 28 extends beyond the sleeve end 50 is a function of the length of the screw driving rod relative to the length of the sleeve.

After the screw has been screwed into a workpiece, the screw driving rod 20 is retracted for moving the drill bit 28 rearwardly of the magazine opening 18 for allowing entry of a new screw into the liner. Upon initial retraction of the screw driving rod 20, the rod slides through the liner 30 which tends to remain in its forward position. However, when the annular ledge 38 (FIG. 2A) adjacent to the forward end of the rod 20 engages the annular ledge 34 on the inside surface of the liner, the liner is also caused to move rearwardly. This is shown in FIG. 1 and, as previously described, rearward movement of the liner and the corresponding rearward movement of the cam follower 128 allows clockwise rotation of the cam wheel 110 by the stretched spring 122 and the attendant raising of the screw strip 56 within the magazine.

With the screw advancing mechanism 98 shown in FIG. 1, driving of the mechanism occurs in response to both forward and rearward movements of the liner; forward for stretching the spring 122, and rearward for allowing contracting of the spring 122. Forward and rearward movements of the liner 30 are also used for activating the screw advancing mechanism shown in FIG. 9 via the rack and pinion mechanism 140 and 144. With the screw advancing mechanisms shown in FIGS. 6, 7 and 8, conversely, all movements of the screw advancing mechanisms are in response solely to rearward movements of the liner 30. As described, during forward movements of the liner, the screw advancing mechanisms are de-clutched from the liner.

FIG. 3 shows a screw strip 56 containing only three screws and the dummy screw 59. During insertion of the bottom-most screw on the strip 56, the dummy screw provides support for this last screw by being supported by the magazine finger 87 (FIG. 5) and by pressing against the back of the magazine.

Also, it should be appreciated that although the invention has been illustrated using Phillips head screws, any suitable screws, other than Phillips head screws, may be used with the automatic screw driving mechanism of the invention.

An advantage of the automatic screw driving mechanism of the invention is that the bit 28 may extend slightly beyond the end 50 of the sleeve. This permits the drill bit 28 to be easily changed for another size screw driving drill bit or for a drill bit to drill a hole.

A still further advantage of the automatic screw driving mechanism of the invention is that the user of the drill may readily operate it to insert screws in the drill bit other than, and independent of, those in the magazine.

Figure 11:
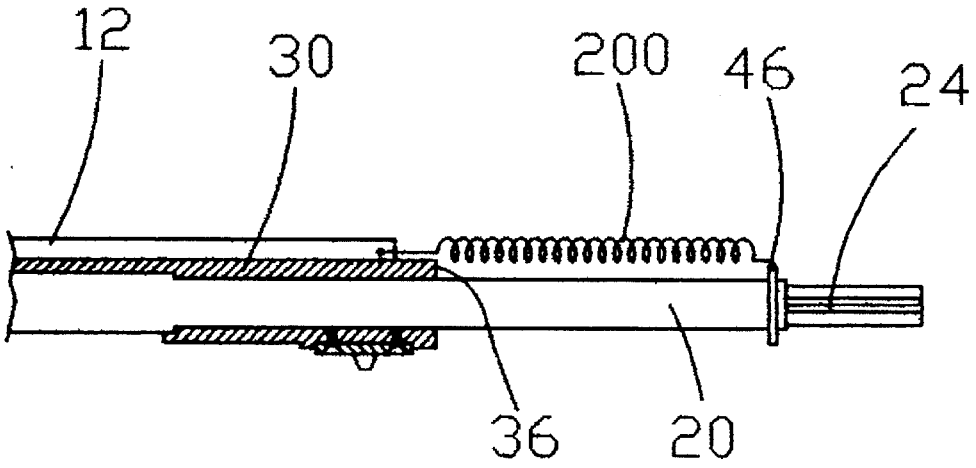
FIG. 11 shows a spring for pushing the screw rod back after it has been urged forward.

It should also be appreciated that, as shown in FIG. 11, a spring 200 may be connected between the sleeve 12 and a point (e.g., 46) on the screw driving rod to cause the screw driving rod to be pushed back after the completion of a forward drilling operation. This enables a more automatic operation of the mechanism.

The magazine enclosing the screws enables the user of the drill to grasp the magazine without any problems while screws are advancing in the magazine. Also, the magazine enables the user of the drill to hold the magazine with one hand and the hand drill with his other hand when in operation. This enables better and more consistent control and the ability to press the screw into the work piece more forcefully. Still further, the magazine may be rotated about the drill rod to enable the user of the drill to operate the drill in different positions and differently contoured areas.

What is claimed is:

1. An automatic screw feeding mechanism comprising an elongated hollow sleeve and a hollow magazine for receipt of screws dependent from said sleeve, a hollow space within said magazine being in communication with the inside of said sleeve, a hollow liner comprising a tubular wall disposed within said sleeve for axial movement within said sleeve, an opening through said liner wall for disposition in overlapping relationship with said magazine hollow space for allowing insertion of a screw in said magazine into said liner through said opening, an elongated screw driving rod disposed within said liner for axial movement through said sleeve for engagement with a screw within said liner, means for releasably latching said rod to said liner for causing selected movements of said liner in response to axial movement of said rod, means associated with said magazine for advancing a screw within the magazine into said liner through said liner wall opening, and means coupling said liner to said screw advancing means for activating said screw advancing means in response to movement of said liner.

2. A mechanism according to claim 1 for successively advancing, in said magazine, a strip of screws held together by a strap connected to and extending between said screws, said mechanism including means for cutting through a strap holding a screw within said liner to a screw strip within said magazine.

3. A mechanism according to claim 2 wherein said sleeve has a front, open end disposed forwardly of said magazine for permitting exiting of a screw within said liner engaged by said screw driving rod, said liner wall opening having an edge moveable, in accordance with movements of said liner, from a first position adjoining a front edge of said space within said magazine to a second position overlying said magazine space and rearwardly of said front edge thereof, said liner opening edge comprising a knife edge and comprising said strap cutting means.

4. A mechanism according to claim 1 for successively advancing, in said magazine, a plurality of screws each having a head end, said magazine including means for positioning the heads of screws within said magazine adjacent to said screw advancing means, and said screw advancing means including means for engaging the ends of screws within said magazine for advancing them, in succession, into said liner.

5. A mechanism according to claim 4 wherein said screw advancing means including a member mounted for rotation about an axis of said member, means for causing rotary motion of said member in response to linear movement of said liner, and said means for engaging ends of screws being activated in response to said rotary motion of said member.

6. A mechanism according to claim 5 wherein said member comprises a cam driven into rotary motion in response to movements of a cam follower mounted on said liner, and said screw engaging means comprising a lever mounted on said cam for arcuate movements in response to rotary motions of said cam.

7. An automatic screw feeding mechanism comprising:

an elongated hollow sleeve and a hollow magazine for receipt of screws dependent from said sleeve, a hollow space within said magazine being in communication with the inside of said sleeve, a hollow liner comprising a tubular wall disposed within said sleeve for axial movement within said sleeve, an opening through said liner wall for disposition in overlapping relationship with said magazine hollow space for allowing insertion of a screw in said magazine into said liner through said opening;

an elongated screw driving rod disposed within said liner for axial movement through said sleeve for engagement with a screw within said liner, said screw driving rod for mounting in the chuck of a hand drill;

means for releasably latching said rod to said liner for causing selected movements of said liner in response to axial movement of said rod, means associated with said magazine for advancing a screw within the magazine into said liner through said liner wall opening, and means coupling said liner to said screw advancing means for activating said screw advancing means in response to movement of said liner, said magazine being contoured for enabling a user to hold the magazine with one hand while screws are advancing within the magazine.

* * * * *